US010976679B2

(12) United States Patent
Tanaka et al.

(10) Patent No.: US 10,976,679 B2
(45) Date of Patent: Apr. 13, 2021

(54) TONER

(71) Applicant: CANON KABUSHIKI KAISHA, Tokyo (JP)

(72) Inventors: Masatake Tanaka, Yokohama (JP); Taiji Katsura, Suntou-gun (JP); Masamichi Sato, Mishima (JP); Shohei Kototani, Suntou-gun (JP); Kentaro Yamawaki, Mishima (JP); Tsuneyoshi Tominaga, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/728,151

(22) Filed: Dec. 27, 2019

(65) Prior Publication Data

US 2020/0209775 A1 Jul. 2, 2020

(30) Foreign Application Priority Data

Dec. 28, 2018 (JP) ..... JP2018-246949

(51) Int. Cl.
*G03G 9/08* (2006.01)
*G03G 9/097* (2006.01)
*G03G 9/087* (2006.01)

(52) U.S. Cl.
CPC ..... *G03G 9/09775* (2013.01); *G03G 9/0819* (2013.01); *G03G 9/08755* (2013.01); *G03G 9/09725* (2013.01)

(58) Field of Classification Search
CPC ..... G03G 9/09775; G03G 9/09725
USPC ..... 430/108.3, 108.6
See application file for complete search history.

(56) References Cited

U.S. PATENT DOCUMENTS

| | | | |
|---|---|---|---|
| 7,833,685 | B2 | 11/2010 | Tanaka et al. |
| 8,372,573 | B2 | 2/2013 | Ayaki et al. |
| 8,377,616 | B2 | 2/2013 | Tani et al. |
| 8,383,313 | B2 | 2/2013 | Ayaki et al. |
| 8,551,680 | B2 | 10/2013 | Ayaki et al. |
| 8,628,899 | B2 | 1/2014 | Kawamura et al. |
| 8,815,484 | B2 | 8/2014 | Tanaka et al. |
| 9,158,216 | B2 | 10/2015 | Shimano et al. |
| 9,341,967 | B2 | 5/2016 | Tsujino et al. |
| 9,366,981 | B2 | 6/2016 | Yamawaki et al. |
| 9,377,705 | B2 | 6/2016 | Shimano et al. |
| 9,383,668 | B2 | 7/2016 | Noji et al. |
| 9,423,708 | B2 | 8/2016 | Tominaga et al. |
| 9,500,972 | B2 | 11/2016 | Tanaka et al. |
| 9,575,424 | B2 | 2/2017 | Nakagawa et al. |
| 9,599,919 | B2 | 3/2017 | Isono et al. |
| 9,632,441 | B2 | 4/2017 | Abe et al. |
| 9,658,549 | B2 | 5/2017 | Tanaka et al. |
| 9,720,340 | B2 | 8/2017 | Tominaga et al. |
| 9,733,583 | B2 | 8/2017 | Kuroki et al. |
| 9,733,584 | B2 | 8/2017 | Masumoto et al. |
| 9,785,071 | B2 | 10/2017 | Shimano et al. |
| 9,785,077 | B2 | 10/2017 | Abe et al. |
| 9,829,816 | B2 | 11/2017 | Tanaka et al. |
| 9,829,820 | B2 | 11/2017 | Masumoto et al. |
| 9,835,964 | B2 | 12/2017 | Yoshida et al. |
| 9,897,932 | B2 | 2/2018 | Hotta et al. |
| 9,904,193 | B2 | 2/2018 | Nakagawa et al. |
| 9,921,501 | B2 | 3/2018 | Mochizuki et al. |
| 9,958,801 | B2 | 5/2018 | Tanaka et al. |
| 10,054,866 | B2 | 8/2018 | Tanaka et al. |
| 10,114,303 | B2 | 10/2018 | Katsura et al. |
| 10,429,757 | B2 | 10/2019 | Yoshida et al. |
| 10,503,090 | B2 | 12/2019 | Tominaga et al. |
| 10,545,422 | B2 | 1/2020 | Yamawaki et al. |
| 2004/0058258 | A1 | 3/2004 | Yoshino et al. |
| 2004/0137356 | A1 | 7/2004 | Tomita et al. |
| 2008/0226998 | A1 | 9/2008 | Ishii et al. |
| 2009/0117477 | A1 | 5/2009 | Magome et al. |
| 2009/0155706 | A1 | 6/2009 | Shu et al. |
| 2010/0035171 | A1 | 2/2010 | Watanabe et al. |
| 2010/0248110 | A1 | 9/2010 | Taguchi et al. |
| 2014/0220488 | A1 | 8/2014 | Hosoya et al. |
| 2014/0356779 | A1 | 12/2014 | Hasegawa et al. |
| 2015/0248072 | A1 | 9/2015 | Katsuta et al. |
| 2016/0187799 | A1 | 6/2016 | Hiroshi et al. |
| 2016/0299446 | A1 | 10/2016 | Kuroki et al. |
| 2017/0219947 | A1 | 8/2017 | Omori et al. |
| 2017/0329246 | A1 | 11/2017 | Yamawaki et al. |
| 2018/0329323 | A1 | 11/2018 | Kimura et al. |
| 2018/0329324 | A1 | 11/2018 | Kamikura et al. |

(Continued)

FOREIGN PATENT DOCUMENTS

| | | |
|---|---|---|
| EP | 0 430 076 | 6/1991 |
| EP | 2 669 740 | 12/2013 |

(Continued)

OTHER PUBLICATIONS

U.S. Appl. No. 16/728,050, Tsuneyoshi Tominaga, filed Dec. 27, 2019.
U.S. Appl. No. 16/728,060, Kentaro Yamawaki, filed Dec. 27, 2019.
U.S. Appl. No. 16/728,082, Yasuhiro Hashimoto, filed Dec. 27, 2019.
U.S. Appl. No. 16/728,101, Taiji Katsura, filed Dec. 27, 2019.
U.S. Appl. No. 16/728,115, Shotaru Nomura, filed Dec. 27, 2019.
U.S. Appl. No. 16/728,122, Masamichi Sato, filed Dec. 27, 2019.
U.S. Appl. No. 16/728,157, Shohei Kototani, filed Dec. 27, 2019.

(Continued)

*Primary Examiner* — Mark A Chapman
(74) *Attorney, Agent, or Firm* — Venable LLP

(57) ABSTRACT

A toner containing: a toner particle that contains a binder resin and an external additive, wherein the external additive contains an organosilicon polymer fine particle, the binder resin contains an amorphous resin and a crystalline polyester resin, a content of the crystalline polyester resin in the binder resin is from 5 to 30 mass %, and the crystalline polyester resin contains from 5 to 25 mass % of a component having a molecular weight of not more than 2,500.

8 Claims, No Drawings

(56) References Cited

U.S. PATENT DOCUMENTS

| | | | |
|---|---|---|---|
| 2018/0329327 | A1 | 11/2018 | Yamawaki et al. |
| 2018/0329329 | A1 | 11/2018 | Nakamura et al. |
| 2019/0332024 | A1 | 10/2019 | Umeda et al. |
| 2020/0026208 | A1 | 1/2020 | Terui |
| 2020/0026209 | A1 | 1/2020 | Yagi et al. |
| 2020/0124998 | A1 | 4/2020 | Kototani et al. |
| 2020/0124999 | A1 | 4/2020 | Tanaka et al. |

FOREIGN PATENT DOCUMENTS

| | | |
|---|---|---|
| EP | 2 818 932 | 12/2014 |
| EP | 2 853 945 | 4/2015 |
| EP | 2 860 585 | 4/2015 |
| EP | 3 095 805 | 11/2016 |
| EP | 3 480 661 | 5/2019 |
| JP | 2017-122873 | 7/2017 |
| WO | 2018/003749 | 1/2018 |

OTHER PUBLICATIONS

U.S. Appl. No. 16/728,171, Takaaki Furui, filed Dec. 27, 2019.
U.S. Appl. No. 16/728,179, Koji Nishikawa, filed Dec. 27, 2019.
U.S. Appl. No. 16/670,352, Kentaro Yamawaki, filed Oct. 31, 2019.

TONER

BACKGROUND OF THE INVENTION

Field of the Invention

The present invention relates to a toner used in image-forming methods such as electrophotographic methods, electrostatic recording methods, and toner jet methods.

Description of the Related Art

Higher image qualities, higher speeds, and longer life have been required of printers and copiers in recent years, and the development of toner that presents an outstanding developing performance, transferability, and durability is also required.

In response to these demands, the addition of polymethylsilsesquioxane fine particles to the surface of the toner base particle has been proposed as one means for improving toner durability. However, polymethylsilsesquioxane fine particles are easily detached from the toner base particle, and as a result image defects and contamination within the image-forming apparatus have ultimately been produced and the durability has not been satisfactory.

To deal with this, an object of Japanese Patent Application Laid-open No. 2017-122873 is to suppress detachment of the polymethylsilsesquioxane fine particles from the toner base particle and thus provide improvement in the image defects and contamination within the image-forming apparatus. A toner is disclosed that contains a toner base particle comprising an amorphous resin and a crystalline resin and that also contains an external additive comprising polyorganosilsesquioxane fine particles having a number-average particle diameter of at least 10 nm but less than 100 nm.

SUMMARY OF THE INVENTION

Additional increases in image quality, in speed, and in the service life are being required at the present time.

With the toner described in Japanese Patent Application Laid-open No. 2017-122873, the detachment of the polyorganosilsesquioxane fine particles is not completely suppressed and image defects are produced during long-term use. Moreover, when polyorganosilsesquioxane fine particles having a larger particle diameter are used, image defects are produced relatively early and thus there is still room for improvement also with regard to the durability.

With respect to a toner that contains organosilicon polymer fine particle, e.g., polyorganosilsesquioxane fine particles, the present invention provides a toner that, notwithstanding detachment of the organosilicon polymer fine particle during long-term use, exhibits an excellent cleaning performance and causes less or no image defects. The present invention additionally provides a toner that equally causes less or no image defects also, e.g., in the case of use of organosilicon polymer fine particle having a larger particle diameter.

The present invention relates to a toner containing:

a toner particle that contains a binder resin; and an external additive, wherein the external additive contains an organosilicon polymer fine particle;

the binder resin contains an amorphous resin and a crystalline polyester resin;

a content of the crystalline polyester resin in the binder resin is from 5 to 30 mass %, and the crystalline polyester resin contains from 5 to 25 mass % of a component having a molecular weight of not more than 2,500.

The present invention can thus provide a toner that, notwithstanding detachment of the organosilicon polymer fine particle during long-term use, exhibits an excellent cleaning performance and causes less or no image defects.

Further features of the present invention will become apparent from the following description of exemplary embodiments.

DESCRIPTION OF THE EMBODIMENTS

Unless otherwise specified, descriptions of numerical ranges such as "from XX to YY" or "XX to YY" in the present invention include the numbers at the upper and lower limits of the range.

The toner according to the present invention is described in additional detail in the following.

As a result of intensive investigations directed to solving the problems identified above for the prior art, the present inventors discovered that—for a toner containing an organosilicon polymer fine particle as an external additive and containing a binder resin that contains an amorphous resin and a crystalline polyester resin—the aforementioned problems could be solved by controlling the content in the crystalline polyester resin of the component having a molecular weight of not more than 2,500 and controlling the content of the crystalline polyester resin in the binder resin.

Thus, the present invention relates to a toner containing:

a toner particle that contains a binder resin; and an external additive, wherein the external additive contains an organosilicon polymer fine particle;

the binder resin contains an amorphous resin and a crystalline polyester resin;

a content of the crystalline polyester resin in the binder resin is from 5 to 30 mass %; and the crystalline polyester resin contains from 5 to 25 mass % of component having a molecular weight of not more than 2,500.

The toner contains an organosilicon polymer fine particle as an external additive.

Compared to inorganic fine particles, e.g., silica fine particles, that are common external additives, the organosilicon polymer fine particle undergo elastic deformation more readily and buffer the shear received by the toner to prevent deformation of the toner particle itself and burial of the external additive in the toner particle, thus providing a greater improvement in toner durability.

The number-average particle diameter of the primary particles of the organosilicon polymer fine particle is preferably from 30 nm to 300 nm and is more preferably from 100 nm to 200 nm.

A trend of better enhancement of the transferability occurs when the number-average particle diameter is at least 30 nm, and the transferability is further enhanced in particular when the number-average particle diameter is at least 100 nm.

Moreover, while the suppression of detachment is impaired at 100 nm and above, the cleaning performance is enhanced with the instant toner due to the mechanism described below and image defects are suppressed.

On the other hand, durability in long-term use is readily obtained at 300 nm and below.

The content of the organosilicon polymer fine particle, per 100 mass parts of the toner particle, is preferably from 1.1 mass parts to 6.0 mass parts and is more preferably from 1.5 mass parts to 3.0 mass parts.

An excellent transferability is readily obtained by having the organosilicon polymer fine particle content be at least 1.1 mass parts, and the retention of this characteristic is also facilitated even during long-term use. While, on the other hand, the occurrence of detachment-induced image defects is facilitated in the case of the prior art, the cleaning performance is nevertheless enhanced due to the mechanism described below and image defects are thereby suppressed.

Obtaining the cleaning performance enhancing effect is facilitated, on the other hand, by having the organosilicon polymer fine particle content be not more than 6.0 mass parts.

The organosilicon polymer fine particle preferably has a structure of alternately binding silicon atoms and oxygen atoms, and a portion of the organosilicon polymer preferably has the T3 unit structure represented by $R^aSiO_{3/2}$. $R^a$ is preferably a hydrocarbon group and is more preferably an alkyl group having 1 to 6 (preferably 1 to 3 and more preferably 1 or 2) carbons (and is more preferably a methyl group) or a phenyl group.

In addition, in $^{29}$Si-NMR measurement of the organosilicon polymer fine particle, a ratio of an area of a peak derived from silicon having the T3 unit structure relative to a total area of peaks derived from all silicon elements contained in the organosilicon polymer fine particle is from 0.90 to 1.00 and more preferably from 0.95 to 1.00.

The toner contains a binder resin.

The binder resin contains an amorphous resin and a crystalline polyester resin.

A content of the crystalline polyester resin in the binder resin is from 5 mass % to 30 mass %. The content is preferably from 5 mass % to 20 mass % and is more preferably from 8 mass % to 15 mass %.

The crystalline polyester resin contains from 5 mass % to 25 mass % of a component having a molecular weight of not more than 2,500. The content is preferably from 5 mass % to 20 mass % and is more preferably from 8 mass % to 15 mass %.

The cleaning performance is enhanced when the binder resin contains at least 5 mass % of a crystalline polyester resin that contains at least 5 mass % of a component having a molecular weight of not more than 2,500.

Adhesion to members by the organosilicon polymer fine particles and toner particle components, as well as the fogging caused by charging defects, are prevented by having the content in the crystalline polyester resin of a component with a molecular weight of not more than 2,500 be 25 mass % or less and having the content of the crystalline polyester resin in the binder resin be 30 mass % or less.

The crystalline polyester resin preferably contains a condensate of at least one monomer selected from the group consisting of α,ω-linear chain aliphatic diols having from 2 to 12 carbons, with at least one monomer selected from the group consisting of α,ω-linear chain aliphatic dicarboxylic acids having from 2 to 12 carbons.

In addition, the crystalline polyester resin preferably contains the condensate that is produced from at least three monomers selected from the group consisting of the α,ω-linear chain aliphatic diols having from 2 to 12 carbons and the α,ω-linear chain aliphatic dicarboxylic acids having from 2 to 12 carbons.

A trend of improvement is established for the cleaning performance by the use of at least three monomers.

This is thought to be due to the following: compared with the use of two monomers, the use of at least three monomers causes a poorer crystallinity and facilitates the transfer to the organosilicon polymer fine particles of the low molecular weight component of the crystalline polyester.

The following mechanism for the functional results is hypothesized based on the preceding.

As long-term use proceeds, the organosilicon polymer fine particles, while being present in very small amounts, undergo a gradual detachment.

The detached organosilicon polymer fine particles have heretofore slipped past the cleaning member and contaminated the charging member, causing image defects. The detached organosilicon polymer fine particles have also contaminated the cleaning member, causing a reduction in the cleaning performance, and as a result the toner has slipped past, also causing image defects.

In contrast to this, with the instant toner, a crystalline polyester resin containing a certain amount of low molecular weight component is itself present in a certain amount in the toner. This low molecular weight component transfers to the detached organosilicon polymer fine particles and facilitates aggregation of the detached organosilicon polymer fine particles with each other, thereby enhancing the cleaning performance.

The driving force for transfer of the low molecular weight component in the crystalline polyester resin to the detached organosilicon polymer fine particles is that the crystalline polyester resin domains present in the toner are present in at least a certain amount. It is also thought to be that the low molecular weight component is present in at least a certain amount in these domains and that the external additive has an organosilicon polymer structure. It is thought that image defects are suppressed as noted above as a consequence.

In addition, it is thought that when this low molecular weight component originates with a crystalline polyester resin, the low molecular weight component is present as a solid in the crystalline polyester resin domains in the toner, and that, because it does not take on its original solid condition when it transfers to the organosilicon polymer fine particle, an action that facilitates the aggregation of the organosilicon polymer fine particle with one another is exhibited.

The individual components constituting the toner and the method for producing the toner are described in the following.

Binder Resin

The toner particle contains a binder resin. The content of the binder resin is preferably at least 50 mass % relative to the overall amount of the resin component in the toner particle.

The binder resin contains an amorphous resin and a crystalline polyester resin.

Amorphous Resin

There are no particular limitations on the amorphous resin, and it can be exemplified by styrene-acrylic resins, epoxy resins, polyester resins, polyurethane resins, polyamide resins, cellulosic resins, and polyether resins and by mixed resins and composite resins of the preceding. Styrene-acrylic resins and polyester resins are preferred in view of their low cost, ease of acquisition, and excellent low-temperature fixability. Styrene-acrylic resins are more preferred because they provide an excellent development durability.

The polyester resins are obtained by synthesis, using a heretofore known method such as, for example, transesterification or polycondensation, from a combination of suitable selections from, e.g., polybasic carboxylic acids, polyols, hydroxycarboxylic acids, and so forth.

The polybasic carboxylic acids are compounds that contain two or more carboxy groups in each molecule. Among these, the dicarboxylic acids are compounds that contain two carboxy groups in each molecule, and their use is preferred.

Examples are oxalic acid, succinic acid, glutaric acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, hexahydroterephthalic acid, malonic acid, pimelic acid, suberic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediacetic acid, o-phenylenediacetic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid.

Polybasic carboxylic acids other than the aforementioned dicarboxylic acids can be exemplified by trimellitic acid, trimesic acid, pyromellitic acid, naphthalenetricarboxylic acid, naphthalenetetracarboxylic acid, pyrenetricarboxylic acid, pyrenetetracarboxylic acid, itaconic acid, glutaconic acid, n-dodecyl succinic acid, n-dodecenylsuccinic acid, isododecylsuccinic acid, isododecenylsuccinic acid, n-octylsuccinic acid, and n-octenylsuccinic acid. A single one of these may be used by itself or two or more may be used in combination.

Polyols are compounds that have at least two hydroxyl groups in each molecule. Among these, diols are compounds that have two hydroxyl groups in each molecule, and their use is preferred.

Specific examples are ethylene glycol, diethylene glycol, triethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanediol, dipropylene glycol, polyethylene glycol, polypropylene glycol, 1,4-cyclohexanediol, 1,4-cyclohexanedimethanol, 1,4-butenediol, neopentyl glycol, polytetramethylene glycol, hydrogenated bisphenol A, bisphenol A, bisphenol F, bisphenol S, and alkylene oxide (e.g., ethylene oxide, propylene oxide, butylene oxide) adducts on these bisphenols. Among the preceding, $C_{2-12}$ alkylene glycols and alkylene oxide adducts on bisphenols are preferred, while alkylene oxide adducts on bisphenols and their combinations with $C_{2-12}$ alkylene glycols are particularly preferred.

At least trihydric alcohols can be exemplified by glycerol, trimethylolethane, trimethylolpropane, pentaerythritol, hexamethylolmelamine, hexaethylolmelamine, tetramethylolbenzoguanamine, tetraethylolbenzoguanamine, sorbitol, trisphenol PA, phenol novolac, cresol novolac, and alkylene oxide adducts on the preceding at least trihydric polyphenols. A single one of these may be used by itself or two or more may be used in combination.

The styrene-acrylic resins can be exemplified by homopolymers of the following polymerizable monomers, or copolymers obtained from a combination of two or more thereof, and by mixtures of the preceding:

styrene and styrene derivatives, e.g., α-methylstyrene, β-methylstyrene, o-methylstyrene, m-methyl styrene, p-methylstyrene, 2,4-dimethyl styrene, p-n-butylstyrene, p-tert-butyl styrene, p-n-hexylstyrene, p-n-octylstyrene, p-n-nonylstyrene, p-n-decylstyrene, p-n-dodecylstyrene, p-methoxystyrene, and p-phenylstyrene;

(meth)acrylic derivatives such as methyl (meth)acrylate, ethyl (meth)acrylate, n-propyl (meth)acrylate, isopropyl (meth)acrylate, n-butyl (meth)acrylate, isobutyl (meth)acrylate, tert-butyl (meth)acrylate, n-amyl (meth)acrylate, n-hexyl (meth)acrylate, 2-ethylhexyl (meth)acrylate, n-octyl (meth)acrylate, n-nonyl (meth)acrylate, cyclohexyl (meth) acrylate, benzyl (meth)acrylate, dimethyl phosphate ethyl (meth)acrylate, diethyl phosphate ethyl (meth)acrylate, dibutyl phosphate ethyl (meth)acrylate, 2-benzoyloxyethyl (meth)acrylate, (meth)acrylonitrile, 2-hydroxyethyl (meth) acrylate, (meth)acrylic acid, and maleic acid;

vinyl ether derivatives such as vinyl methyl ether and vinyl isobutyl ether; vinyl ketone derivatives such as vinyl methyl ketone, vinyl ethyl ketone, and vinyl isopropenyl ketone; and polyolefins such as ethylene, propylene, and butadiene.

The styrene-acrylic resin may optionally use a multifunctional polymerizable monomer. The multifunctional polymerizable monomer can be exemplified by diethylene glycol di(meth)acrylate, triethylene glycol di(meth)acrylate, tetraethylene glycol di(meth)acrylate, polyethylene glycol di(meth)acrylate, 1,6-hexanediol di(meth)acrylate, neopentyl glycol di(meth)acrylate, tripropylene glycol di(meth) acrylate, polypropylene glycol di(meth)acrylate, 2,2'-bis(4-((meth)acryloxydiethoxy)phenyl)propane, trimethylolpropane tri(meth)acrylate, tetramethylolmethane tetra(meth)acrylate, divinylbenzene, divinylnaphthalene, and divinyl ether.

A known chain transfer agent and polymerization inhibitor may also be added in order to control the degree of polymerization.

The polymerization initiator used to obtain the styrene-acrylic resin can be exemplified by organoperoxide-type initiators and azo-type polymerization initiators.

The organoperoxide-type initiators can be exemplified by benzoyl peroxide, lauroyl peroxide, di-α-cumyl peroxide, 2,5-dimethyl-2,5-bis(benzoylperoxy)hexane, bis(4-t-butylcyclohexyl) peroxydicarbonate, 1,1-bis(t-butylperoxy)cyclododecane, t-butyl peroxymaleate, bis(t-butylperoxy) isophthalate, methyl ethyl ketone peroxide, tert-butyl peroxy-2-ethylhexanoate, diisopropyl peroxycarbonate, cumene hydroperoxide, 2,4-dichlorobenzoyl peroxide, and tert-butyl peroxypivalate.

The azo-type polymerization initiators are exemplified by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobismethylbutyronitrile, and 2,2'-azobis(methyl isobutyrate).

A redox initiator, comprising the combination of an oxidizing substance with a reducing substance, may also be used as the polymerization initiator. The oxidizing substance can be exemplified by inorganic peroxides such as hydrogen peroxide and persulfate salts (sodium salt, potassium salt, and ammonium salt) and by oxidizing metal salts such as tetravalent cerium salts. The reducing substance can be exemplified by reducing metal salts (divalent iron salts, monovalent copper salts, and trivalent chromium salts); ammonia; lower amines (amines having from 1 to about 6 carbons, such as methylamine and ethylamine); amino compounds such as hydroxylamine; reducing sulfur compounds such as sodium thiosulfate, sodium hydrosulfite, sodium bisulfite, sodium sulfite, and sodium formaldehyde sulfoxylate; lower alcohols (from 1 to 6 carbons); ascorbic acid and its salts; and lower aldehydes (from 1 to 6 carbons).

The polymerization initiator is selected considering its 10-hour half-life decomposition temperature, and a single one or a mixture may be used. The amount of addition of the polymerization initiator will vary with the desired degree of polymerization, but generally from 0.5 mass parts to 20.0 mass parts is added per 100.0 mass parts of the polymerizable monomer.

Crystalline Polyester Resin

The crystalline polyester resin can be obtained, for example, by the reaction of an at least dibasic polybasic carboxylic acid with an at least dihydric polyhydric alcohol. A crystalline polyester resin for which the main starting materials are an aliphatic dicarboxylic acid and an aliphatic diol is preferred because this facilitates obtaining a desirable melting point and because such a crystalline polyester resin has a high crystallinity.

The polyhydric alcohol can be exemplified by ethylene glycol, diethylene glycol, triethylene glycol, 1,2-propanediol, 1,3-propanediol, dipropylene glycol, tetramethylene glycol, pentamethylene glycol, hexamethylene glycol, octamethylene glycol, nonamethylene glycol, decamethylene glycol, dodecamethylene glycol, neopentyl glycol, and 1,4-butadiene glycol.

This is preferably at least one monomer selected from the group consisting of α,ω-linear chain aliphatic diols having from 2 to 12 (more preferably from 4 to 10) carbons.

The polybasic carboxylic acid can be exemplified by oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, itaconic acid, isophthalic acid, terephthalic acid, n-dodecyl succinic acid, n-dodecenylsuccinic acid, and cyclohexanedicarboxylic acid, and the anhydrides and lower alkyl esters of these acids.

This is preferably at least one monomer selected from the group consisting of α,ω-linear chain aliphatic dicarboxylic acids having from 2 to 12 (more preferably from 4 to 10) carbons and the anhydrides and lower alkyl esters of these acids.

This crystalline polyester resin also has a content of a component having a molecular weight of not more than 2,500 in the crystalline polyester resin of at least 5 mass %, which is more low molecular weight component than heretofore.

The method for obtaining this crystalline polyester resin can be, for example, as follows: a method in which the monomer is divided up, a portion is condensed to a certain degree, the remaining monomer is then added, and additional condensation is subsequently carried out; and a method in which a low molecular weight crystalline polyester resin and a high molecular weight crystalline polyester resin are synthesized and melt mixing is performed at a ratio that provides the desired molecular weight distribution.

In order to adjust the acid value and hydroxyl value, a method may be used in which the polymer terminals of the crystalline polyester resin are capped, and this capping is preferably carried out so as to place an alkyl chain having at least 6 carbons at the polymer terminals. This serves to facilitate the generation of improvements in the heat-resistant storability.

A monobasic acid or a monohydric alcohol is used to cap the polymer terminals. The monobasic acid can be exemplified by acetic acid, propionic acid, butyric acid, octanoic acid, decanoic acid, dodecanoic acid, stearic acid, and behenic acid. The monohydric alcohol can be exemplified by methanol, ethanol, propanol, butanol, octanol, decanol, dodecanol, stearyl alcohol, and behenyl alcohol.

When too many types of monomers are used to produce the crystalline polyester resin, the crystalline polyester resin then exhibits a broad melting behavior and the heat-resistant storability assumes a declining trend, and from three to five monomers are thus preferred.

Release Agent

The toner particle may contain a release agent. A known wax may be used as this release agent.

Specific examples are petroleum waxes as represented by paraffin waxes, microcrystalline waxes, and petrolatum, and derivatives thereof; montan wax and derivatives thereof; hydrocarbon waxes provided by the Fischer-Tropsch method, and derivatives thereof polyolefin waxes as represented by polyethylene, and derivatives thereof and natural waxes as represented by carnauba wax and candelilla wax, and derivatives thereof.

The derivatives include oxides as well as block copolymers and graft modifications with vinyl monomers. Additional examples are alcohols such as higher aliphatic alcohols; fatty acids such as stearic acid and palmitic acid, and their acid amides, esters, and ketones; hydrogenated castor oil and derivatives thereof plant waxes; and animal waxes. A single one of these or a combination may be used.

The developing performance and transferability assume an improving trend with the use, among the preceding, of a polyolefin, hydrocarbon wax provided by the Fischer-Tropsch method, or petroleum wax, which is thus preferred. An antioxidant may be added to these waxes within a range that does not influence the effects of the present invention.

From the standpoint of the phase separation behavior with respect to the binder resin or the crystallization temperature, higher fatty acid esters, e.g., behenyl behenate, dibehenyl sebacate, and so forth, are favorable examples.

The content of the release agent is preferably from 1.0 mass parts to 30.0 mass parts per 100.0 mass parts of the binder resin.

The melting point of the release agent is preferably from 30° C. to 120° C. and is more preferably from 60° C. to 100° C.

The release effect is efficiently exhibited and a broader fixing region is secured through the use of a release agent having such a thermal characteristic.

Colorant

The toner particle may contain a colorant. Known pigments and dyes can be used as the colorant. Pigments are preferred for the colorant from the standpoint of providing an excellent weathering resistance.

Cyan colorants can be exemplified by copper phthalocyanine compounds and derivatives thereof, anthraquinone compounds, and basic dye lake compounds.

Specific examples are as follows: C. I. Pigment Blue 1, C. I. Pigment Blue 7, C. I. Pigment Blue 15, C. I. Pigment Blue 15:1, C. I. Pigment Blue 15:2, C. I. Pigment Blue 15:3, C. I. Pigment Blue 15:4, C. I. Pigment Blue 60, C. I. Pigment Blue 62, and C. I. Pigment Blue 66.

Magenta colorants can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are as follows: C. I. Pigment Red 2, C. I. Pigment Red 3, C. I. Pigment Red 5, C. I. Pigment Red 6, C. I. Pigment Red 7, C. I. Pigment Red 19, C. I. Pigment Red 23, C. I. Pigment Red 48:2, C. I. Pigment Red 48:3, C. I. Pigment Red 48:4, C. I. Pigment Red 57:1, C. I. Pigment Red 81:1, C. I. Pigment Red 122, C. I. Pigment Red 144, C. I. Pigment Red 146, C. I. Pigment Red 150, C. I. Pigment Red 166, C. I. Pigment Red 169, C. I. Pigment Red 177, C. I. Pigment Red 184, C. I. Pigment Red 185, C. I. Pigment Red 202, C. I. Pigment Red 206, C. I. Pigment Red 220, C. I. Pigment Red 221, C. I. Pigment Red 254, and C. I. Pigment Violet 19.

Yellow colorants can be exemplified by condensed azo compounds, isoindolinone compounds, anthraquinone compounds, azo-metal complexes, methine compounds, and allylamide compounds.

Specific examples are as follows: C. I. Pigment Yellow 12, C. I. Pigment Yellow 13, C. I. Pigment Yellow 14, C. I. Pigment Yellow 15, C. I. Pigment Yellow 17, C. I. Pigment Yellow 62, C. I. Pigment Yellow 74, C. I. Pigment Yellow 83, C. I. Pigment Yellow 93, C. I. Pigment Yellow 94, C. I. Pigment Yellow 95, C. I. Pigment Yellow 97, C. I. Pigment Yellow 109, C. I. Pigment Yellow 110, C. I. Pigment Yellow 111, C. I. Pigment Yellow 120, C. I. Pigment Yellow 127, C. I. Pigment Yellow 128, C. I. Pigment Yellow 129, C. I. Pigment Yellow 147, C. I. Pigment Yellow 151, C. I. Pigment Yellow 154, C. I. Pigment Yellow 155, C. I. Pigment Yellow 168, C. I. Pigment Yellow 174, C. I. Pigment Yellow 175, C. I. Pigment Yellow 176, C. I. Pigment Yellow 180, C. I. Pigment Yellow 181, C. I. Pigment Yellow 185, C. I. Pigment Yellow 191, and C. I. Pigment Yellow 194.

Black colorants can be exemplified by carbon black and by black colorants provided by color mixing using the aforementioned yellow colorants, magenta colorants, and cyan colorants to give a black color.

A single one or a mixture of these colorants can be used, and these may also be used in the form of solid solutions.

The colorant content is preferably from 1.0 mass parts to 20.0 mass parts per 100.0 mass parts of the binder resin.

Charge Control Agent and Charge Control Resin

The toner particle may contain a charge control agent or a charge control resin.

A known charge control agent can be used as the charge control agent, wherein a charge control agent that provides a fast triboelectric charging speed and that can maintain a defined and stable triboelectric charge quantity is particularly preferred. When the toner particle is produced by a suspension polymerization method, a charge control agent that exercises little polymerization inhibition and that is substantially free of material soluble in the aqueous medium is particularly preferred.

Charge control agents comprise charge control agents that control toner to negative charging and charge control agents that control toner to positive charging. Charge control agents that control the toner to negative charging can be exemplified by monoazo metal compounds; acetylacetone-metal compounds; metal compounds of aromatic oxycarboxylic acids, aromatic dicarboxylic acids, oxycarboxylic acids, and dicarboxylic acids; aromatic oxycarboxylic acids, aromatic monocarboxylic acids, and aromatic polycarboxylic acids and their metal salts, anhydrides, and esters; phenol derivatives such as bisphenol; urea derivatives; metal-containing salicylic acid compounds; metal-containing naphthoic acid compounds; boron compounds; quaternary ammonium salts; calixarene; and charge control resins.

Charge control agents that control the toner to positive charging can be exemplified by the following: guanidine compounds; imidazole compounds; quaternary ammonium salts such as tributylbenzylammonium 1-hydroxy-4-naphthosulfonate and tetrabutylammonium tetrafluoroborate, and their onium salt analogues, such as phosphonium salts, and their lake pigments; triphenylmethane dyes and their lake pigments (the laking agent is exemplified by phosphotungstic acid, phosphomolybdic acid, phosphomolybdotungstic acid, tannic acid, lauric acid, gallic acid, ferricyanides, and ferrocyanides); metal salts of higher fatty acids; and charge control resins.

Among these charge control agents, metal-containing salicylic acid compounds are preferred and metal-containing salicylic acid compounds in which the metal is aluminum or zirconium are particularly preferred.

The charge control resin can be exemplified by polymers and copolymers having a sulfonic acid group, sulfonate salt group, or sulfonate ester group. Polymer having a sulfonic acid group, sulfonate salt group, or sulfonate ester group is particularly preferably a polymer that contains at least 2 mass %, as the copolymerization ratio, of a sulfonic acid group-containing acrylamide-type monomer or sulfonic acid group-containing methacrylamide-type monomer, and more preferably is a polymer containing at least 5 mass % of same.

The charge control resin preferably has a glass transition temperature (Tg) from 35° C. to 90° C., a peak molecular weight (Mp) from 10,000 to 30,000, and a weight-average molecular weight (Mw) from 25,000 to 50,000. When this is used, preferred triboelectric charging characteristics can be conferred without exercising an influence on the thermal characteristics required of a toner particle. Moreover, because the charge control resin contains a sulfonic acid group, for example, the dispersibility of the charge control resin itself as well as the dispersibility of, e.g., the colorant, in the polymerizable monomer composition is improved and the tinting strength, transparency, and triboelectric charging characteristics can then be further improved.

A single one of these charge control agents and charge control resins may be added by itself, or combinations of two or more may be added.

The amount of addition of the charge control agent or charge control resin, per 100.0 mass parts of the binder resin, is preferably from 0.01 mass parts to 20.0 mass parts and is more preferably from 0.5 mass parts to 10.0 mass parts.

Method for Producing the Organosilicon Polymer Fine Particles

The method of manufacturing the organosilicon polymer fine particle is not particularly limited, and for example it can be obtained by dripping a silane compound into water, hydrolyzing it with a catalyst and performing a condensation reaction, after which the resulting suspension is filtered and dried. The particle diameter can be controlled by means of the type and compounding ratio of the catalyst, the reaction initiation temperature, and the dripping time and the like.

Examples of the catalyst include, but are not limited to, acidic catalysts such as hydrochloric acid, hydrofluoric acid, sulfuric acid, nitric acid and the like, and basic catalysts such as ammonia water, sodium hydroxide, potassium hydroxide and the like.

The organosilicon compound for producing the organosilicon polymer fine particle is explained below.

The organosilicon polymer is preferably a polycondensate of an organosilicon compound having a structure represented by the following formula (Z):

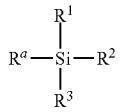

(Z)

In formula (Z), $R^a$ represents an organic functional group, and each of R', $R^2$ and $R^3$ independently represents a halogen atom, hydroxyl group or acetoxy group, or a (preferably $C_{1-3}$) alkoxy group.

$R^a$ is an organic functional group without any particular limitations, but preferred examples include $C_{1-6}$ (preferably $C_{1-3}$, more preferably $C_{1-2}$) hydrocarbon groups (preferably alkyl groups) and aryl (preferably phenyl) groups.

Each of $R^1$, $R^2$ and $R^3$ independently represents a halogen atom, hydroxyl group, acetoxy group or alkoxy group. These are reactive groups that form crosslinked structures by hydrolysis, addition polymerization and condensation. Hydrolysis, addition polymerization and condensation of $R^1$, $R^2$ and $R^3$ can be controlled by means of the reaction temperature, reaction time, reaction solvent and pH. An organosilicon compound having three reactive groups ($R^1$, $R^2$ and $R^3$) in the molecule apart from $R^a$ as in formula (Z) is also called a trifunctional silane.

Examples of formula (Z) include the following:

trifunctional methylsilanes such as p-styryl trimethoxysilane, methyl trimethoxysilane, methyl triethoxysilane, methyl diethoxymethoxysilane, methyl ethoxydimethoxysilane, methyl trichlorosilane, methyl methoxydichlorosilane, methyl ethoxydichlorosilane, methyl dimethoxychlorosilane, methyl methoxyethoxychlorosilane, methyl diethoxychlorosilane, methyl triacetoxysilane, methyl diacetoxymethoxysilane, methyl diacetoxyethoxysilane, methyl acetoxydimethoxysilane, methyl acetoxymethoxyethoxysilane, methyl acetoxydiethoxysilane, methyl trihydroxysilane, methyl methoxydihydroxysilane, methyl ethoxydihydroxysilane, methyl dimethoxyhydroxysilane, methyl ethoxymethoxyhydroxysilane and methyl diethoxyhydroxysilane; trifunctional ethylsilanes such as ethyl trimethoxysilane, ethyl triethoxysilane, ethyl trichlorosilane, ethyl triacetoxysilane and ethyl trihydroxysilane; trifunctional propylsilanes such as propyl trimethoxysilane, propyl triethoxysilane, propyl trichlorosilane, propyl triacetoxysilane and propyl trihydroxysilane; trifunctional butylsilanes such as butyl trimethoxysilane, butyl triethoxysilane, butyl trichlorosilane, butyl triacetoxysilane and butyl trihydroxysilane; trifunctional hexylsilanes such as hexyl trimethoxysilane, hexyl triethoxysilane, hexyl trichlorosilane, hexyl triacetoxysilane and hexyl trihydroxysilane; and trifunctional phenylsilanes such as phenyl trimethoxysilane, phenyl triethoxysilane, phenyl trichlorosilane, phenyl triacetoxysilane and phenyl trihydroxysilane. These organosilicon compounds may be used individually, or two or more kinds may be combined.

The following may also be used in combination with the organosilicon compound having the structure represented by formula (Z): organosilicon compounds having four reactive groups in the molecule (tetrafunctional silanes), organosilicon compounds having two reactive groups in the molecule (bifunctional silanes), and organosilicon compounds having one reactive group in the molecule (monofunctional silanes). Examples include:

dimethyl diethoxysilane, tetraethoxysilane, hexamethyl disilazane, 3-aminopropyl trimethoxysilane, 3-aminopropyl triethoxysilane, 3-(2-aminoethyl)aminopropyl trimethoxysilane, 3-(2-aminoethyl)aminopropyl triethoxysilane, and trifunctional vinyl silanes such as vinyl triisocyanatosilane, vinyl trimethoxysilane, vinyl triethoxysilane, vinyl diethoxymethoxysilane, vinyl ethoxydimethoxysilane, vinyl ethoxydihydroxysilane, vinyl dimethoxyhydroxysilane, vinyl ethoxymethoxyhydroxysilane and vinyl diethoxyhydroxysilane.

The content of the structure represented by formula (Z) in the monomers forming the organosilicon polymer is preferably at least 50 mol %, or more preferably at least 60 mol %.

Method for Producing the Toner Particle

The method for manufacturing the toner particle is explained next.

The method for manufacturing the toner particle is not particularly limited, and a known method may be used, such as a kneading pulverization method or wet manufacturing method for example. A wet method is preferred from the standpoint of shape control and obtaining a uniform particle diameter. Wet methods include suspension polymerization methods, dissolution suspension methods, emulsion polymerization and aggregation methods, and emulsion aggregation methods, and it is preferred to use an emulsion aggregation method.

In emulsion aggregation methods, a fine particle of a binder resin and a fine particle of another material such as a colorant as necessary are dispersed and mixed in an aqueous medium containing a dispersion stabilizer. A surfactant may also be added to this aqueous medium. A flocculant is then added to aggregate the mixture until the desired toner particle size is reached, and the resin fine particles are also melt adhered together either after or during aggregation. Shape control with heat may also be performed as necessary in this method to form a toner particle.

The fine particle of the binder resin here may be a composite particle formed as a multilayer particle comprising two or more layers composed of different resins. For example, this can be manufactured by an emulsion polymerization method, mini-emulsion polymerization method, phase inversion emulsion method or the like, or by a combination of multiple manufacturing methods.

When the toner contains an internal additive such as a colorant, the colorant may be included in the resin fine particle, or a dispersion of an internal additive fine particle consisting solely of the internal additive can be prepared separately, and the internal additive fine particle can then by aggregated together with the resin fine particle.

Resin fine particles with different compositions may also be added at different times during aggregation, and aggregated to prepare a toner particle composed of layers with different compositions.

The following may be used as the dispersion stabilizer:

inorganic dispersion stabilizers such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

Other examples include organic dispersion stabilizers such as polyvinyl alcohol, gelatin, methyl cellulose, methyl hydroxypropyl cellulose, ethyl cellulose, carboxymethyl cellulose sodium salt, and starch.

A known cationic surfactant, anionic surfactant or nonionic surfactant may be used as the surfactant.

Specific examples of cationic surfactants include dodecyl ammonium bromide, dodecyl trimethylammonium bromide, dodecylpyridinium chloride, dodecylpyridinium bromide, hexadecyltrimethyl ammonium bromide and the like.

Specific examples of nonionic surfactants include dodecylpolyoxyethylene ether, hexadecylpolyoxyethylene ether, nonylphenylpolyoxyethylene ether, lauryl polyoxyethylene ether, sorbitan monooleate polyoxyethylene ether, styrylphenyl polyoxyethylene ether, monodecanoyl sucrose and the like.

Specific examples of anionic surfactants include aliphatic soaps such as sodium stearate and sodium laurate, and sodium lauryl sulfate, sodium dodecylbenzene sulfonate, sodium polyoxyethylene (2) lauryl ether sulfate and the like.

The methods for measuring the various properties pertaining to the present invention are described in the following.

Measurement of the Weight-Average Particle Diameter (D4) and Number-Average Particle Diameter (D1) of the Toner or Toner Particle The weight-average particle diameter (D4) and the number-average particle diameter (D1) of the toner or toner particle are determined by carrying out the measurements in 25,000 channels for the number of effective measurement channels and performing analysis of the measurement data using a "Coulter Counter Multisizer 3" (registered trademark, Beckman Coulter, Inc.), a precision particle size distribution measurement instrument operating on the pore electrical resistance method and equipped with a 100-μm aperture tube, and using the accompanying dedicated software, i.e., "Beckman Coulter Multisizer 3 Version 3.51" (Beckman Coulter, Inc.) to set the measurement conditions and analyze the measurement data.

The aqueous electrolytic solution used in measurement may be a solution of special grade sodium chloride dissolved in ion-exchanged water to a concentration of about 1 mass %, such as "ISOTON II" (Beckman Coulter, Inc.) for example.

The following settings are performed on the dedicated software prior to measurement and analysis.

On the "Change standard measurement method (SOMME)" screen of the dedicated software, the total count number in control mode is set to 50,000 particles, the number of measurements to 1, and the Kd value to a value obtained with "Standard particles 10.0 μm" (Beckman Coulter, Inc.). The threshold and noise level are set automatically by pushing the "Threshold/noise level measurement" button. The current is set to 1,600 μA, the gain to 2, and the electrolytic solution to ISOTON II, and a check is entered for "Aperture tube flush after measurement".

On the "Conversion settings from pulse to particle diameter" screen of the dedicated software, the bin interval is set to the logarithmic particle diameter, the particle diameter bins to 256, and the particle diameter range to 2 to 60 μm.

The specific measurement methods are as follows.

(1) About 200 mL of the aqueous electrolytic solution is placed in a glass 250 mL round-bottomed beaker dedicated to the Multisizer 3, the beaker is set on the sample stand, and stirring is performed with a stirrer rod counter-clockwise at a rate of 24 rps. Contamination and bubbles in the aperture tube are then removed by the "Aperture tube flush" function of the dedicated software.

(2) 30 mL of the same aqueous electrolytic solution is placed in a glass 100 mL flat-bottomed beaker, and about 0.3 mL of a dilution of "Contaminon N" (a 10 mass % aqueous solution of a pH 7 neutral detergent for washing precision instruments, comprising a nonionic surfactant, an anionic surfactant, and an organic builder, manufactured by Wako Pure Chemical Industries, Ltd.) diluted about three times by mass with ion-exchange water is added.

(3) An ultrasonic disperser "Ultrasonic Dispersion System Tetra150" (Nikkaki Bios Co., Ltd.) with an electrical output of 120 W equipped with two built-in oscillators having an oscillating frequency of 50 kHz with their phases shifted by 180° from each other s prepared. About 3.3 L of ion-exchange water is added to the water tank of the ultrasonic disperser, and about 2 mL of Contaminon N is added to the tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolytic solution in the beaker.

(5) The aqueous electrolytic solution in the beaker of (4) above is exposed to ultrasound as about 10 mg of toner or toner particle is added bit by bit to the aqueous electrolytic solution, and dispersed. Ultrasound dispersion is then continued for a further 60 seconds. During ultrasound dispersion, the water temperature in the tank is adjusted appropriately to from 10° C. to 40° C.

(6) The aqueous electrolytic solution of (5) above with the toner or toner particle dispersed therein is dripped with a pipette into the round-bottomed beaker of (1) above set on the sample stand, and adjusted to a measurement concentration of about 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4), and when set to graph/number % with the dedicated software, the "average diameter" on the "analysis/numerical statistical value (arithmetic average)" screen is the number-average particle diameter (D1).

Measurement of the Molecular Weight of the Toners, Resins, and so Forth

The molecular weight of the toners, resins, and so forth is measured as follows using gel permeation chromatography (GPC).

First, the sample, e.g., toner and so forth, is dissolved in tetrahydrofuran (THF) at room temperature. The obtained solution is filtered with a "Sample Pretreatment Cartridge" (Tosoh Corporation) solvent-resistant membrane filter having a pore diameter of 0.2 μm to obtain a sample solution. The sample solution is adjusted to a concentration of THF-soluble component of 0.8 mass %. Measurement is carried out under the following conditions using this sample solution.

Instrument: "HLC-8220GPC" high-performance GPC instrument [Tosoh Corporation]
Column: 2×LF-604 [Showa Denko Kabushiki Kaisha]
Eluent: THF
Flow rate: 0.6 mL/min
Oven temperature: 40° C.
Sample injection amount: 0.020 mL A molecular weight calibration curve constructed using polystyrene resin standards (product name: "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Identification of the Composition and Ratios for the Constituent Compounds of the Organosilicon Polymer Fine Particle The composition and ratios for the constituent compounds of the organosilicon polymer fine particles contained in the toner are identified using solid pyrolysis gas chromatography-mass analysis (pyrolysis GC/MS in the following) and NMR.

When the toner contains a silica fine particle in addition to the organosilicon polymer fine particle, 1 g of the toner is dissolved and dispersed in 31 g of chloroform in a vial. This is dispersed for 30 minutes with an ultrasound homogenizer to prepare a liquid dispersion.

Ultrasonic processing unit: VP-050 ultrasound homogenizer (Taitec Corporation)

Microchip: Step microchip, tip diameter φ 2 mm

Microchip tip position: Center of glass vial and 5 mm above bottom of vial

Ultrasound conditions: Intensity 30%, 30 minutes

Ultrasound is applied while cooling the vial with ice water so that the temperature of the dispersion does not rise.

The dispersion is transferred to a swing rotor glass tube (50 mL), and centrifuged for 30 minutes under conditions of 58.33 $S^{-1}$ with a centrifuge (H-9R; Kokusan Co., Ltd.). After centrifugation, the glass tube contains silica fine particles with heavy specific gravity in the lower layer. The chloroform solution containing organosilicon polymer fine particles in the upper layer is collected, and the chloroform is removed by vacuum drying (40° C./24 hours) to obtain organosilicon polymer fine particles.

Using these organosilicon polymer fine particles, the abundance of the constituent compounds of the organosilicon polymer fine particles and the proportion for the T3 unit structure in the organosilicon polymer fine particles are measured and calculated using solid-state $^{29}$Si-NMR.

The hydrocarbon group represented by $R^a$ above is confirmed by $^{13}$C-NMR.

$^{13}$C-NMR (Solid) Measurement Conditions

Unit: JNM-ECX500II (JEOL RESONANCE Inc.)

Sample tube: 3.2 mm φ

Sample: sample or the organosilicon polymer fine particles

Measurement temperature: Room temperature

Pulse mode: CP/MAS

Measurement nuclear frequency: 123.25 MHz ($^{13}$C)

Standard substance: Adamantane (external standard: 29.5 ppm)

Sample rotation: 20 kHz

Contact time: 2 ms

Delay time: 2 s

Number of integrations: 1024

In this method, the hydrocarbon group represented by $R^a$ above is confirmed based on the presence or absence of signals attributable to methyl groups (Si—$CH_3$), ethyl groups (Si—$C_2H_5$), propyl groups (Si—$C_3H_7$), butyl groups (Si—$C_4H_9$), pentyl groups (Si—$C_5H_{11}$), hexyl groups (Si—$C_6H_{13}$) or phenyl groups (Si—$C_6H_5$—) bound to silicon atoms.

In solid $^{29}$Si-NMR, on the other hand, peaks are detected in different shift regions depending on the structures of the functional groups binding to Si in the constituent compounds of the organosilicon polymer fine particle.

The structures binding to Si can be specified by using standard samples to specify each peak position. The abundance ratio of each constituent compound can also be calculated from the resulting peak areas. The ratio of the peak area of T3 unit structures relative to the total peak area can also be determined by calculation.

The measurement conditions for solid $^{29}$Si-NMR are as follows for example.

Unit: JNM-ECX5002 (JEOL RESONANCE Inc.)

Temperature: Room temperature

Measurement method: DDMAS method, $^{29}$Si 45°

Sample tube: Zirconia 3.2 mm φ

Sample: Packed in sample tube in powder form

Sample rotation: 10 kHz

Relaxation delay: 180 s

Scan: 2,000

After this measurement, the peaks of the multiple silane components having different substituents and linking groups in the organosilicon polymer fine particle are separated by curve fitting into the following X1, X2, X3 and X4 structures, and the respective peak areas are calculated.

The X3 structure below is the T3 unit structure according to the present invention.

X1structure: $(Ri)(Rj)(Rk)SiO_{1/2}$ (A1)

X2 structure: $(Rg)(Rh)Si(O_{1/2})_2$ (A2)

X3 structure: $RmSi(O_{1/2})_3$ (A3)

X4structure: $Si(O_{1/2})_4$ (A4)

X1 Structure:

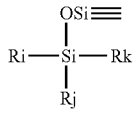

(A1)

X2 Structure:

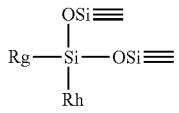

(A2)

X3 Structure:

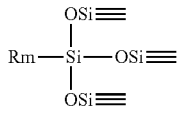

(A3)

X4 Structure:

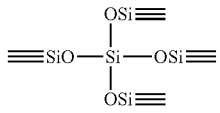

(A4)

Ri, Rj, Rk, Rg, Rh and Rm in formulae (A1), (A2) and (A3) represent halogen atoms, hydroxyl groups, acetoxy groups, alkoxy groups or organic groups such as $C_{1-6}$ hydrocarbon groups bound to silicon.

When a structure needs to be confirmed in more detail, it can be identified from $^{1}$H-NMR measurement results in addition to the above $^{13}$C-NMR and $^{29}$Si-NMIR measurement results.

In addition, solid pyrolysis GC/MS may be used to analyze the types of constituent compounds in the organosilicon polymer fine particle.

The types of constituent compounds in the organosilicon polymer fine particle can be identified by measuring the mass spectrum of the components in the pyrolyzate from the organosilicon polymer fine particle that is produced by pyrolysis of the toner at about 550° C. to 700° C., and analyzing the pyrolysis peaks.

Measurement Conditions for Pyrolysis GC/MS

Pyrolysis instrument: JPS-700 (Japan Analytical Industry Co., Ltd.)

Pyrolysis temperature: 590° C.

GC/MS instrument: Focus GC/ISQ (Thermo Fisher)

Column: HP-SMS, length 60 m, inner diameter 0.25 mm, film thickness 0.25 μm

Injection port temperature: 200° C.

Flow pressure: 100 kPa

Split: 50 mL/min

MS ionization: EI

Ion source temperature: 200° C., Mass Range 45-650

Quantitation of the Organosilicon Polymer Fine Particles Contained in the Toner

The content of the organosilicon polymer fine particles contained in the toner is determined using the following method.

When the toner contains a silicon-containing material other than the organosilicon polymer fine particles, as described above the toner is dispersed in a solvent, e.g., chloroform, and the silicon-containing material other than the organosilicon polymer fine particles is then removed based on the specific gravity difference using, e.g., centrifugal separation; this is followed by the determination of the content of the organosilicon polymer fine particles.

First, the pressed toner is measured using X-ray fluorescence and the silicon content in the toner is determined by carrying out analysis by, e.g., a calibration curve procedure or an FP procedure.

Then, for the individual constituent compounds that form the organosilicon polymer fine particles, using, e.g., solid-state $^{29}$Si-NMR and pyrolysis GC/MS, the structure is identified and the silicon content in the organosilicon polymer fine particles is determined. The content of the organosilicon polymer fine particles in the toner can be obtained by calculation from the relationship between the silicon content in the toner that is determined by X-ray fluorescence and the silicon content in the organosilicon polymer fine particles as determined using solid-state $^{29}$Si-NMR and pyrolysis GC/MS.

Measurement of the Number-Average Primary Particle Diameter of the Organosilicon Polymer Fine Particles Measurement of the number-average particle diameter of the primary particles of the organosilicon polymer fine particle is performed using an "S-4800" scanning electron microscope (product name, Hitachi, Ltd.).

Observation is carried out on the toner to which organosilicon polymer fine particles have been externally added; in a visual field enlarged by a maximum of 50,000×, the long diameter of the primary particles of 100 randomly selected organosilicon polymer fine particles is measured; and the arithmetic average value thereof is taken to be the number-average particle diameter.

The enlargement factor in the observation is adjusted as appropriate depending on the size of the organosilicon polymer fine particles.

The organosilicon polymer fine particles are discriminated from other external additives by a combination of observation with the "S-4800" scanning electron microscope (product name, Hitachi, Ltd.) and EDS-based elemental analysis.

The toner is observed in a visual field enlarged by a maximum of 50,000×. The toner particle surface is brought into focus and the external additive is observed. EDS analysis is performed on the external additive, and the determination is made, based on the presence/absence of a peak for the element Si, as to whether the analyzed particles are organosilicon polymer fine particles.

When the toner contains both organosilicon polymer fine particles and silica fine particles, the organosilicon polymer fine particles are identified by comparing the ratio (Si/O ratio) for the Si and O element contents (atomic %) with a standard.

EDS analysis is carried out under the same conditions on standards for both the organosilicon polymer fine particles and silica fine particles, and the Si/O ratios are calculated from the Si and O element contents (atomic %).

Using "A" for the Si/O ratio for the organosilicon polymer fine particles and "B" for the Si/O ratio for the silica fine particles, measurement conditions are selected whereby A is significantly larger than B.

Specifically, the measurement is run ten times under the same conditions on the standards and the arithmetic mean value is obtained for both A and B. Measurement conditions are selected whereby the obtained average values satisfy $AB>1.1$.

Using the same conditions as for measurement on the standards, EDS analysis is carried out on the external additive on the toner. When the Si/O ratio for an external additive on the toner is on the A side from $[(A+B)/2]$, this fine particle is then scored as an organosilicon polymer fine particle.

For example, Tospearl 120A (Momentive Performance Materials Japan LLC) is used as the standard for the organosilicon polymer fine particle, and HDK V15 (Asahi Kasei Corporation) is used as the standard for the silica fine particles.

When the organosilicon polymer fine particle prior to external addition can be acquired, the number-average particle diameter can be determined using these.

Separation of the Crystalline Polyester Resin and Measurement of the Content of the Crystalline Polyester Resin in the Binder Resin The toner is introduced into chloroform and thorough shaking is performed after standing for several hours at 25° C.; the toner is thoroughly mixed with methyl ethyl ketone (MEK); and standing at quiescence is additionally carried out for at least 12 hours until there is no coalescence of the sample. The crystalline polyester component is separated by subjecting the obtained solution to silica gel column chromatography, followed by recovery and drying to solidity.

The crystalline polyester component is isolated by using, e.g., chloroform, hexane, methanol, and so forth, as the developing solvent and adjusting the mixing ratio.

The content of the crystalline polyester resin in the binder resin is calculated from the obtained mass of the crystalline polyester resin.

The content (mass) of the binder resin in the toner is determined by separating the binder resin component by silica gel chromatography as described above, performing compositional analysis according to the Method for Analyzing the Resin Composition described below, and then calculation from the integration values in the spectrum obtained by $^1$H-NMR measurement of the toner.

Measurement of the Molecular Weight Distribution of the Crystalline Polyester Resin The molecular weight distribution of the crystalline polyester resin is measured as follows using gel permeation chromatography (GPC).

First, 50 mg of the sample is introduced into 5 mL of chloroform; standing for several hours at 25° C. is carried out; thorough shaking is performed to thoroughly mix with the chloroform; and standing at quiescence is additionally carried out for at least 24 hours until there is no coalescence of the sample.

The obtained solution is filtered with an "H-25-5 Sample Pretreatment Cartridge" (Tosoh Corporation) solvent-resistant membrane filter having a pore diameter of 0.5 μm to obtain a sample solution. Measurement is carried out under the following conditions using this sample solution.

Instrument: "Lab solutions GPC" high-performance GPC instrument (Shimadzu Corporation)
Column: PLgel 5 μm MIXED-C 300×7.5 mm (Agilent Technologies): 2; PLgel 5 μm Guard 50×7.5 mm (Agilent Technologies): 1
Eluent: chloroform
Flow rate: 1.0 mL/min
Oven temperature: 45° C.
Sample injection amount: 60 μL
Detector: RI (refractive index) detector A molecular weight calibration curve constructed using polystyrene resin standards (product name: "TSK Standard Polystyrene F-850, F-450, F-288, F-128, F-80, F-40, F-20, F-10, F-4, F-2, F-1, A-5000, A-2500, A-1000, A-500", Tosoh Corporation) is used for the molecular weight of the sample.

The content [unit: mass %] of molecular weight of not more than 2,500 is determined from the intersection between a molecular weight of 2,500 and the cumulative molecular weight distribution curve.

Method for Analyzing the Resin Composition

The resin composition is analyzed through measurement of the NMR spectrum.

The NMR spectrum of the resin is measured using nuclear magnetic resonance spectroscopic analysis ($^1$H-NMR) [400 MHz, $CDCl_3$, room temperature (25° C.)].

Measurement instrument: JNM-EX400 FT-NMR instrument (JEOL Ltd.)
Measurement frequency: 400 MHz
Pulse condition: 5.0 μs
Frequency range: 10,500 Hz
Number of scans: 64

Compositional analysis is performed based on the NMR spectrum measured in accordance with this procedure.

EXAMPLES

The present invention is more specifically described in the following using examples. The present invention is not limited to or by the following examples. Unless specifically indicated otherwise, "parts" in the text is on a mass basis.

Organosilicon Polymer Fine Particle 1 Production Example

Step 1

360.0 parts of water was introduced into a reaction vessel fitted with a thermometer and a stirrer, and 13.0 parts of hydrochloric acid having a concentration of 5.0 mass % was added to provide a uniform solution. While stirring this at a temperature of 25° C., 136.0 parts of methyltrimethoxysilane was added, stirring was performed for 5 hours, and filtration was carried out to obtain a transparent reaction solution containing a silanol compound or partial condensate thereof.

Step 2

540.0 parts of water was introduced into a reaction vessel fitted with a thermometer, stirrer, and dropwise addition apparatus, and 15.0 parts of ammonia water having a concentration of 10.0 mass % was added to provide a uniform solution.

While stirring this at a temperature of 40° C., 100.0 parts of the reaction solution obtained in the Step 1 was added dropwise over 2.00 hours, and stirring was performed for 6 hours to obtain a suspension.

The resulting suspension was processed with a centrifugal separator and the fine particles were sedimented and withdrawn and were dried for 24 hours with a dryer at a temperature of 200° C. to obtain organosilicon polymer fine particle 1.

The resulting organosilicon polymer fine particle 1 had a number-average particle diameter of the primary particles of 20 nm, a T3 unit structure represented by $R^aSiO_{3/2}$, $R^a$ for a methyl group, and a proportion of 1.00 for the area of the peak originating from silicon having the T3 unit structure.

Organosilicon Polymer Fine Particles 2 to 6 Production Examples

Organosilicon polymer fine particles 2 to 6 were obtained proceeding as in the Organosilicon Polymer Fine Particle 1 Production Example, but changing the silane compound, reaction start temperature, amount of addition of ammonia water, and duration of dropwise addition of the reaction solution as shown in Table 1. The properties of the resulting organosilicon polymer fine particles 2 to 6 are given in Table 1.

TABLE 1

| Organosilicon polymer fine particle | Step 1 | | | | |
|---|---|---|---|---|---|
| | Water | Hydrochloric acid | Reaction temperature | Silane compound | |
| No. | Parts | Parts | ° C. | Name | Parts |
| 1 | 360.0 | 13.0 | 25 | Methyltrimethoxysilane | 136.0 |
| 2 | 360.0 | 15.0 | 25 | Methyltrimethoxysilane | 136.0 |
| 3 | 360.0 | 19.0 | 25 | Methyltrimethoxysilane | 136.0 |

TABLE 1-continued

| | | | | | |
|---|---|---|---|---|---|
| 4 | 360.0 | 22.0 | 25 | Methyl-trimethoxysilane | 136.0 |
| 5 | 360.0 | 23.0 | 25 | Methyl-trimethoxysilane | 136.0 |
| 6 | 360.0 | 10.0 | 25 | Penty trimethoxysilane | 190.0 |

| Organo- | Step 2 | | | | | Number-average | |
|---|---|---|---|---|---|---|---|
| silicon polymer fine particle No. | Reaction solution obtained in Step 1 Parts | Water Parts | Ammonia water Parts | Reaction initiation temperature ° C. | Dripping time hours | particle diameter of primary particles (nm) | T |
| 1 | 100.0 | 540.0 | 15.0 | 40 | 2.00 | 20 | 1.00 |
| 2 | 100.0 | 540.0 | 17.0 | 35 | 0.50 | 100 | 1.00 |
| 3 | 100.0 | 540.0 | 20.0 | 30 | 0.29 | 200 | 1.00 |
| 4 | 100.0 | 540.0 | 22.0 | 30 | 0.21 | 300 | 1.00 |
| 5 | 100.0 | 540.0 | 23.0 | 30 | 0.17 | 350 | 1.00 |
| 6 | 100.0 | 540.0 | 12.0 | 40 | 1.50 | 30 | 1.00 |

In the table, T represents a ratio of an area of a peak derived from silicon having the T3 unit structure relative to a total area of peaks derived from all silicon elements contained in the organosilicon polymer fine particle.

Crystalline Polyester Resin 1 Production Example

First, in a reaction step 1, 117.0 parts of 1,6-hexanediol, 100.0 parts of sebacic acid, and 100.0 parts of 1,10-decanedicarboxylic acid and 0.6 parts of titanium(IV) isopropoxide as esterification catalyst were introduced into a reaction vessel and were reacted for 4 hours at 150° C. Then, in a reaction step 2, 11.7 parts of 1,6-hexanediol, 10.0 parts of sebacic acid, and 10.0 parts of 1,10-decanedicarboxylic acid were added and a reaction was carried out for 4 hours at 180° C. The reaction was continued at 180° C. and 1 hPa until the desired molecular weight distribution was reached to obtain crystalline polyester resin 1. The properties are given in Table 2.

Crystalline Polyester Resins 2 to 5 Production Example

Crystalline polyester resins 2 to 5 were obtained by the same method as in the Crystalline Polyester Resin 1 Production Example, but changing to the formulations given in Table 2. The properties are given in Table 2.

Crystalline Polyester Resin (Comparative 1) Production Example 100.0 parts of 1,10-decanediol and 92.0 parts of sebacic acid and 0.6 parts of titanium(IV) isopropoxide as esterification catalyst were introduced into a reaction vessel and were reacted for 4 hours at 150° C. The reaction was continued at 180° C. and 1 hPa until the desired molecular weight distribution was reached to obtain crystalline polyester resin (comparative 1). The properties are given in Table 2.

Crystalline Polyester Resin (Comparative 2) Production Example

Crystalline polyester resin (comparative 2) was obtained by the same method as in the Crystalline Polyester Resin 1 Production Example, but changing to the formulation given in Table 2. The properties are given in Table 2.

Crystalline Polyester Resin (Comparative 3) Production Example 302.0 parts of sebacic acid and 123.0 parts of 1,12-dodecanediol were introduced into a reaction vessel under a nitrogen atmosphere and were heated to 170° C. and dissolved.

A solution of 55.0 parts of styrene, 14.0 parts of n-butyl acrylate, 6.0 parts of acrylic acid, and 11.0 parts of di-t-butyl peroxide was added dropwise to this over 90 minutes.

Stirring was performed for an additional 60 minutes after the completion of dropwise addition, followed by the removal of unreacted addition-polymerizing monomer under reduced pressure (8 kPa). 0.8 parts of titanium(IV) butoxide was then added at normal pressure (101.3 kPa) as esterification catalyst and the temperature was raised to 235° C. and a reaction was run for 5 hours and additionally for 1 hour under reduced pressure (8 kPa).

After then cooling to 200° C., the reaction was continued under reduced pressure (20 kPa) until the weight-average molecular weight reached 16,000 to obtain crystalline polyester resin (comparative 3), which had 15 mass % of a styrene-acrylic resin skeleton. The properties are given in Table 2.

TABLE 2

| Crystalline polyester | Reaction step 1 | | Reaction step 2 | | Number of monomer | Weight-average molecular weight | Component with a molecular weight of not more than 2,500 |
|---|---|---|---|---|---|---|---|
| resin No. | Monomer | Parts | Monomer | Parts | types | (Mw) | (mass %) |
| 1 | 1,10-DDCA | 100.0 | 1,10-DDCA | 10.0 | 3 | 17000 | 10 |
| | SA | 100.0 | SA | 10.0 | | | |
| | 1,6-HD | 117.0 | 1,6-HD | 11.7 | | | |
| 2 | SA | 92.0 | SA | 9.2 | 2 | 16000 | 10 |
| | 1,10-DD | 100.0 | 1,10-DD | 10.0 | | | |

TABLE 2-continued

| Crystalline polyester resin No. | Reaction step 1 Monomer | Reaction step 1 Parts | Reaction step 2 Monomer | Reaction step 2 Parts | Number of monomer types | Weight-average molecular weight (Mw) | Component with a molecular weight of not more than 2,500 (mass %) |
|---|---|---|---|---|---|---|---|
| 3 | SA | 100.0 | SA | 10.0 | 3 | 16000 | 10 |
| | 1,6-HD | 31.0 | 1,6-HD | 3.1 | | | |
| | 1,12-DD | 53.0 | 1,12-DD | 5.3 | | | |
| 4 | SA | 100.0 | SA | 5.0 | 3 | 18000 | 5 |
| | 1,4-BD | 24.0 | 1,4-BD | 1.2 | | | |
| | 1,12-DD | 53.0 | 1,12-DD | 2.7 | | | |
| 5 | SA | 100.0 | SA | 20.0 | 3 | 18000 | 25 |
| | EG | 16.0 | EG | 3.2 | | | |
| | 1,12-DD | 53.0 | 1,12-DD | 10.6 | | | |
| Comparative 1 | Described in the Specification | | | | 2 | 16000 | 3 |
| Comparative 2 | SA | 100.0 | SA | 25.0 | 2 | 12000 | 30 |
| | 1,10-DD | 92.0 | 1,10-DD | 23.0 | | | |
| Comparative 3 | Described in the Specification | | | | 2 | 16000 | 3 |

In the table,
1,10-DDCA represents "1,10-decanedicarboxylic acid",
SA represents "Sebacic acid",
1,6-HD represents "1,6-hexanediol",
1,10-DD represents "1,10-decanediol",
1,12-DD represents "1,12-dodecanediol",
1,4-BD represents "1,4-butanediol", and
EG represents "Ethylene glycol".

Toner 1 Production Example

Preparation of an Amorphous Resin Particle Dispersion 75.0 parts of styrene, 25.0 parts of butyl acrylate, 1.5 parts of acrylic acid, and 3.2 parts of n-lauryl mercaptan were mixed with dissolution. To this mixed solution was added an aqueous solution of 1.5 parts of Neogen RK (Dai-ichi Kogyo Seiyaku Co., Ltd.) added and mixed into 150 parts of deionized water, and dispersion was carried out. While slowly stirring for an additional 10 minutes, an aqueous solution of 0.3 parts of potassium persulfate mixed in 10 parts of deionized water was added.

After substitution with nitrogen, an emulsion polymerization was run for 6 hours at 70° C. After the completion of the polymerization, the reaction solution was cooled to room temperature and a resin particle dispersion having a median diameter on a volume basis of 200 nm and a solids concentration of 20.0 mass % was obtained by the addition of deionized water.

Preparation of a Crystalline Polyester Resin Particle Dispersion

| | |
|---|---|
| crystalline polyester resin 1 | 100 parts |
| methyl ethyl ketone | 200 parts |

These materials were gradually introduced into a vessel and stirring was performed and complete dissolution was achieved; 40° C. was established and, while stirring, an aqueous solution of 1.5 parts of Neogen RK (Dai-ichi Kogyo Seiyaku Co., Ltd.) mixed in 150 parts of deionized water was gradually added dropwise to induce phase inversion emulsification. The solvent was removed under reduced pressure to obtain a crystalline polyester resin particle dispersion 1. The volume-average particle diameter of the resin particles was 155 nm. The resin particle solids concentration was adjusted with deionized water to 20.0 mass %.

Preparation of a Colorant Particle Dispersion

| | |
|---|---|
| copper phthalocyanine (Pigment Blue 15:3) | 45 parts |
| Neogen RK ionic surfactant (Dai-ichi Kogyo Seiyaku Co., Ltd.) | 5 parts |
| deionized water | 190 parts |

These components were mixed, and were dispersed for 10 minutes using a homogenizer (Ultra-Turrax, IKA) and then subjected to a dispersion treatment for 20 minutes at a pressure of 250 MPa using an Ultimizer (a countercollision wet pulverizer, Sugino Machine Limited) to obtain a colorant particle dispersion having a solids concentration of 20 mass % and a volume-average particle diameter for the colorant particles of 120 nm.

Preparation of a Release Agent Particle Dispersion

| | |
|---|---|
| release agent (hydrocarbon wax, melting point: 79° C.) | 50 parts |
| Neogen RK ionic surfactant (Dai-ichi Kogyo Seiyaku Co., Ltd.) | 2 parts |
| deionized water | 200 parts |

The preceding was heated to 100° C. and was thoroughly dispersed using an Ultra-Turrax T50 from IKA. This was followed by heating to 115° C. and a 1-hour dispersion treatment using a Gaulin pressure ejection homogenizer to give a release agent particle dispersion having a solids concentration of 20 mass % and a volume-average particle diameter for the release agent of 160 nm.

Toner Particle Production 300.0 parts of the amorphous resin particle dispersion, 35.0 parts of the crystalline polyester resin particle dispersion 1, 20.0 parts of the colorant particle dispersion, and 25.0 parts of the release agent particle dispersion were introduced into a reaction vessel and the temperature in the vessel was adjusted to 30° C. while stirring.

A 1 mol/L aqueous sodium hydroxide solution was added to the resulting solution to adjust the pH to 8.0. An aqueous solution of 0.3 parts magnesium sulfate as aggregating agent dissolved in 10.0 parts of deionized water was added over 10 minutes while stirring at 30° C.

Heating was begun after standing for 3 minutes, and heating was carried out to 50° C. and the production of aggregated particles was performed.

While in this condition, the particle diameter of the aggregated particles was measured using a "Coulter Counter Multisizer 3" (registered trademark, Beckman Coulter, Inc.). At the point at which the number-average particle diameter of the aggregated particles had reached 7 μm, 3.0 parts of sodium chloride and 8.0 parts of Neogen RK were added and particle growth was stopped.

This was followed by heating to 95° C. to carry out adhesion and spheronizing of the aggregated particles.

Cooling was started at the point at which the average circularity had reached 0.980, and cooling was carried out to 30° C.; hydrochloric acid was added to adjust the pH to 1.5 or below; stirring and standing was carried out for 1 hour; and solid-liquid separation was then performed using a pressure filter to obtain a toner cake.

This was reslurried with deionized water and solid-liquid separation was carried out again. This was repeated until the electrical conductivity reached 5.0 μS/cm or less to obtain a toner cake.

The resulting toner cake was dried with a Flash Jet Dryer air current dryer (Seishin Enterprise Co., Ltd.) to obtain a toner particle 1. The drying conditions were an injection temperature of 90° C. and a dryer outlet temperature of 40° C., and the toner cake feed rate was adjusted in correspondence to the water content of the toner cake to a rate such that the outlet temperature did not deviate from 40° C.

Toner 1 Production Example 100 parts of toner particle 1 and 1.5 parts of organosilicon polymer fine particle 2 were introduced into an FM mixer (Model FM10C, Nippon Coke & Engineering Co., Ltd.). A toner mixture 1 was obtained by mixing for 5 minutes at a peripheral velocity for the stirring blades of 38 m/sec. During this interval, the amount of water flowing through the jacket was adjusted as appropriate so the temperature in the tank of the FM mixer did not exceed 25° C. The obtained toner mixture 1 was sieved on a mesh with an aperture of 75 μm to obtain a toner 1.

Toners 2 to 10 Production Example

Toners 2 to 10 were obtained using the same method as in the Toner 1 Production Example, but changing the type of crystalline polyester resin and type of organosilicon polymer fine particle and its amount of addition as shown in Table 3 and proceeding so the content of the crystalline polyester resin assumed the numerical values in Table 3.

Comparative Toners 1 to 4 Production Example

Comparative toners 1 to 4 were obtained using the same method as in the Toner 1 Production Example, but changing the type of crystalline polyester resin and type of organosilicon polymer fine particle and its amount of addition as shown in Table 3 and proceeding so the content of the crystalline polyester resin assumed the numerical values in Table 3.

TABLE 3

| | Crystalline polyester resin | | Organosilicon polymer fine particle | |
|---|---|---|---|---|
| Toner No. | Type | Content (mass %) | Type | Parts |
| 1 | 1 | 10 | 2 | 1.5 |
| 2 | 2 | 10 | 2 | 1.5 |
| 3 | 3 | 30 | 6 | 1.5 |
| 4 | 4 | 5 | 3 | 1.2 |
| 5 | 5 | 10 | 4 | 1.5 |
| 6 | 1 | 10 | 2 | 0.5 |
| 7 | 1 | 10 | 2 | 1.1 |
| 8 | 1 | 10 | 2 | 6.0 |
| 9 | 1 | 10 | 1 | 1.5 |
| 10 | 1 | 10 | 5 | 1.5 |
| Comparative 1 | 2 | 40 | 2 | 1.0 |
| Comparative 2 | Comparative 1 | 40 | 2 | 1.0 |
| Comparative 3 | Comparative 2 | 10 | 2 | 1.0 |
| Comparative 4 | Comparative 3 | 30 | 2 | 1.0 |

In the table, the content (mass %) of the crystalline polyester resin indicates the content (mass %) of the crystalline polyester resin in the binder resin.

Evaluation of the Toners

The following evaluations were performed using an LBP652C laser beam printer from Canon, Inc., that had been modified to enable adjustment of the fixation temperature and process speed.

Evaluation of the Drum Cleaning Performance (Evaluation 1)

This evaluation was performed in a normal-temperature, normal-humidity environment (temperature of 23° C./humidity of 60% RH). A4 CS-680 (grammage=68 g/m$^2$) was used as the transfer material.

Output was temporarily stopped after the output of 100 prints of a 1% print percentage image and after the output of 10,000 prints of the 1% print percentage image, and a pattern image in which the whole side was a solid region was output on the paper (the toner laid-on level on the paper in the solid region was 0.40 mg/cm$^2$).

Using an X-Rite color reflection densitometer ("500 Series", X-Rite, Incorporated), the image density was measured at ten locations on the whole-side solid image after the output of 100 prints and at ten locations on the whole-side solid image after the output of 10,000 prints.

The drum cleaning performance was evaluated using the difference between the maximum value and the minimum value of these image densities (image density difference) to elucidate the degree of contamination of the charging roller (charging member) after the output of 100 prints and after the output of 10,000 prints. A score of D or higher is an acceptable level for the present invention.

Evaluation Criteria

A: the image density difference is less than 0.03

B: the image density difference is at least 0.03, but less than 0.05

C: the image density difference is at least 0.05, but less than 0.08

D: the image density difference is at least 0.08, but less than 0.12

E: the image density difference is at least 0.12

Toner Adhesion to the Blade (Evaluation 2)

This evaluation was performed in a normal-temperature, normal-humidity environment (temperature of 23° C./humidity of 60% RH). A4 CS-680 (grammage=68 g/m$^2$) was used as the transfer material. After the continuous output of 10,000 prints of a 1% print percentage image, the developer container was disassembled and the evaluation was performed by visual observation of the surface and edge of the toner carrying member.

Evaluation Criteria

A: circumferential streaks due to interposition of foreign material between the toner control member and the toner carrying member caused by toner fracture or adhesion are entirely absent at the surface and edge of the toner carrying member B: some foreign material interposition between the toner carrying member and toner edge seal is seen C: 1 to 4 circumferential streaks are seen at the edge D: 5 or more circumferential streaks are seen over the whole region Fogging (Evaluation 3)

This evaluation was performed in a high-temperature, high-humidity environment (temperature=33° C./humidity=85% RH). A4 CS-680 (grammage=68 g/m$^2$) was used as the transfer material. 10,000 prints of a 1% print percentage image were output followed by standing for 48 hours. Another image was subsequently output, and the reflectance (%) in the nonimage area of this image was measured using a "Reflectometer Model TC-6DS" (Tokyo Denshoku Co., Ltd.).

The evaluation was performed using the numerical value (%) provided by subtracting the obtained reflectance from the reflectance (%), measured in the same manner, of the virgin paper (reference paper) used for printing out. A smaller numerical value is indicative of a greater suppression of image fogging.

Evaluation Criteria

A: less than 1.0%

B: at least 1.0%, but less than 2.0%

C: at least 2.0%, but less than 5.0%

D: at least 5.0%

Image Density Stability (Evaluation 4)

This evaluation was performed in a normal-temperature, normal-humidity environment (temperature of 23° C./humidity of 60% RH). 8,000 prints of a solid whole-area image (toner laid-on level=0.40 mg/cm$^2$) were continuously output, and the evaluation was performed using the percentage reduction in the image density for the 8,000th image versus the 20th image.

Using a MacBeth RD918 reflection densitometer (MacBeth Corporation) and operating in accordance with the instruction manual provided therewith, the image density was measured as the relative density versus an image of a white background area in which the original density was 0.00.

Evaluation Criteria

A: the percentage reduction in the density is less than 5%

B: the percentage reduction in the density is at least 5%, but less than 10%

C: the percentage reduction in the density is at least 10%, but less than 20%

D: the percentage reduction in the density is at least 20%

Ghosting (Evaluation 5)

This evaluation was performed in a low-temperature, low-humidity environment (15.0° C., 10% RH). A4 CS-680 (grammage=68 g/m$^2$) was used as the transfer material. 300 prints of a monochrome solid white image having a print percentage of 0% were printed out, followed by the output of a monochrome ghost evaluation image.

The ghost evaluation image had seven 15 mm×15 mm solid images, aligned in a single horizontal row with a gap of 15 mm between them, at a position 5 mm from the front edge of the transfer paper, and below these solid images had a halftone image with a toner laid-on level of 0.20 mg/cm$^2$.

Density differences caused by the 15 mm×15 mm solid images in the halftone region of this image were visually scored.

Evaluation Criteria

A: tint differences are entirely absent

B: very slight tint differences are observed

C: slight tint differences are observed

D: tint differences are clearly observed

Low-Temperature Fixability (Evaluation 6)

This evaluation was performed in a normal-temperature, normal-humidity environment (temperature of 23° C./humidity of 60% RH).

Operating at a process speed of 320 mm/sec, solid images (toner laid-on level: 0.40 mg/cm$^2$) were formed with the fixation temperature being changed in 5° C. intervals.

A general-purpose paper (A4 size, XEROX 4200 paper, Xerox Corporation, 75 g/m$^2$) was used as the transfer material. The fixed image was rubbed 10 times using Kimwipes [S-200 (Nippon Paper Crecia Co., Ltd.)] under a load of 75 g/cm$^2$, and the low-temperature fixability was evaluated using the temperature at which the pre-versus-post-rubbing percentage reduction in density was less than 5%.

Evaluation Criteria

A: 140° C.

B: 145° C.

C: 150° C.

D: 155° C.

Examples 1 to 10

The preceding evaluations were performed in Examples 1 to 10 using toners 1 to 10, respectively. The results of these evaluations are given in Table 4.

Comparative Examples 1 to 4

The preceding evaluations were performed in Comparative Examples 1 to 4 using comparative toners 1 to 4, respectively. The results of these evaluations are given in Table 4.

TABLE 4

| | Toner No. | Evaluation 1 | Evaluation 2 | Evaluation 3 | Evaluation 4 | Evaluation 5 | Evaluation 6 |
|---|---|---|---|---|---|---|---|
| Example 1 | 1 | A(0.01) | A | A(0.2) | A(3) | A | A |
| Example 2 | 2 | C(0.06) | A | A(0.2) | A(2) | A | A |
| Example 3 | 3 | A(0.01) | A | A(0.3) | A(2) | B | A |
| Example 4 | 4 | B(0.03) | A | A(0.4) | A(3) | A | C |
| Example 5 | 5 | B(0.03) | B | B(1.5) | A(4) | A | A |

TABLE 4-continued

| | Toner No. | Evaluation 1 | Evaluation 2 | Evaluation 3 | Evaluation 4 | Evaluation 5 | Evaluation 6 |
|---|---|---|---|---|---|---|---|
| Example 6 | 6 | A(0.02) | A | A(0.6) | C(15) | A | B |
| Example 7 | 7 | A(0.01) | A | A(0.6) | B(6) | A | A |
| Example 8 | 8 | B(0.04) | A | A(0.3) | A(3) | A | C |
| Example 9 | 9 | B(0.04) | B | A(0.4) | B(8) | C | B |
| Example 10 | 10 | A(0.01) | A | C(4.2) | B(6) | A | A |
| Comparative Example 1 | Comparative 1 | B(0.04) | D | D(8.1) | D(25) | A | A |
| Comparative Example 2 | Comparative 2 | E(0.15) | D | B(1.8) | D(28) | A | A |
| Comparative Example 3 | Comparative 3 | B(0.04) | D | D(9.2) | D(30) | A | A |
| Comparative Example 4 | Comparative 4 | E(0.17) | D | C(4.8) | D(32) | C | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-246949, filed Dec. 28, 2018, which is hereby incorporated by reference herein in its entirety.

What is claimed is:

1. A toner, comprising:

a toner particle that contains a binder resin, the binder resin comprising an amorphous resin and a crystalline polyester resin; and an external additive comprising an organosilicon polymer fine particle, wherein a content of the crystalline polyester resin in the binder resin is 5 to 30 mass %; and the crystalline polyester resin contains 5 to 25 mass % of a component having a molecular weight of not more than 2,500.

2. The toner according to claim 1, wherein the crystalline polyester resin comprises a condensate of at least one α,ω-linear chain aliphatic diol monomer having 2 to 12 carbons with at least one α,ω-linear chain aliphatic dicarboxylic acid monomer having 2 to 12 carbons.

3. The toner according to claim 2, wherein the crystalline polyester resin is produced from at least three monomers selected from the group consisting of the α,ω-linear chain aliphatic diols and the α,ω-linear chain aliphatic dicarboxylic acids.

4. The toner according to claim 1, wherein the organosilicon polymer fine particle has a structure of alternately binding silicon atoms and oxygen atoms, a portion of the organosilicon polymer has a T3 unit structure represented by $R^aSiO_{3/2}$ where $R^a$ represents an alkyl group having 1 to 6 carbons or phenyl group; and in $^{29}$Si-NMR measurement of the organosilicon polymer line particle, a ratio of an area of a peak derived from silicon having the T3 unit structure relative to a total area of peaks derived from all silicon elements contained in the organosilicon polymer fine particle is 0.90 to 1.00.

5. The toner according to claim 4, wherein the ratio of an area of a peak derived from silicon having the T3 unit structure relative to a total area of peaks derived from all silicon elements contained in the organosilicon polymer fine particle is 0.95 to 1.00.

6. The toner according to claim 4, wherein $R^a$ is a methyl group.

7. The toner according to claim 1, wherein primary particles of the organosilicon polymer fine particle have a number-average particle diameter of 30 to 300 nm.

8. The toner according to claim 1, wherein a content of the organosilicon polymer fine particle is 1.1 to 6.0 mass parts per 100 mass parts of the toner particle.

* * * * *